United States Patent [19]

Konucik

[11] Patent Number: 4,941,210

[45] Date of Patent: Jul. 17, 1990

[54] QUICK-CHANGE SWEAT BAND

[76] Inventor: George J. Konucik, P.O. Box 9482, Richmond, Va. 23228

[21] Appl. No.: 278,761

[22] Filed: Dec. 2, 1988

[51] Int. Cl.[5] ..... A42C 5/02

[52] U.S. Cl. ..... 2/171; 2/181.4; 2/183; 2/197; 2/209.3 DIG. 11

[58] Field of Search ..... 2/181, 181.4, 12, 199, 2/10, 185 R, DIG. 6, 183, 197, DIG. 11, 171, 209.3

[56] References Cited

U.S. PATENT DOCUMENTS

| | | | |
|---|---|---|---|
| 1,484,042 | 2/1924 | Smilie | 2/171 X |
| 2,810,913 | 10/1957 | Kennedy | 2/197 X |
| 3,184,758 | 5/1965 | Hirsch | 2/DIG. 11 |
| 3,906,548 | 9/1975 | Kallis | 2/181.4 |
| 4,481,681 | 11/1984 | Hankin | 2/183 X |
| 4,630,317 | 12/1986 | Brown et al. | 2/12 |
| 4,648,137 | 3/1987 | Cooper | 2/DIG. 6 X |
| 4,698,852 | 10/1987 | Romero | 2/171 |
| 4,811,430 | 3/1989 | Janusz | 2/DIG. 11 X |
| 4,856,116 | 8/1989 | Sullivan | 2/12 X |

OTHER PUBLICATIONS

WO83/04164, Cooper, "Garment Protector", 12-1983.

Gershman, "Self-Adhering Nylon Tapes", 10-1958, p. 930, J.A.M.A., vol. 68, No. 7.

*Primary Examiner*—Peter Nerbun

*Attorney, Agent, or Firm*—Richard L. Miller

[57] ABSTRACT

This quick-change sweat band or pad is designed to be comfortable and is attached to the existing sweat band manufactured in a cap or other head-wear or garments. Primarily, it consists of a loop pile fastener adhered permanently to the existing sweat band or garment, and a hook pile fastener is similarly secured to an absorbent band or pad for engagement with the loop pile fastener. The combination of the hook pile fastener and the pad are quickly removed for replacement and washing when needed, and prevents odors from perspiration in the cap visor and the existing sweat band and/or other garments.

1 Claim, 1 Drawing Sheet

QUICK-CHANGE SWEAT BAND

BACKGROUND OF THE INVENTION

The instant invention relates generally to perspiration absorbing head-wear and like garments, and more particularly, to a quick-change sweat band.

Numerous articles have been provided in the prior art that are adapted to absorb perspiration. For example, U.S. Pat. Nos. 4,742,581 of Rosenthal, 4,502,156 of Wishman, and 4,394,782 of Wasson, all are illustrative of such prior art. While these units may be suitable for the particular purpose to which they address, they would not be as suitable for the purpose of the present invention as hereafter described.

SUMMARY OF THE INVENTION

A primary object of the present invention is to provide a quick-change sweat band that will overcome the shortcomings of the prior art devices.

Another object is to provide a quick-change sweat band that will be of such design, as to be removably secured to the existing sweat band of a cap or other head-wear and/or garment.

An additional object is to provide a quick-change sweat band that will include mating hook and loop pile fasteners for attachment to the existing sweat band of head-wear and/or garment.

A further object is to provide a quick-change sweat band that is simple and easy to use.

A still further object is to provide a quick change sweat band that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
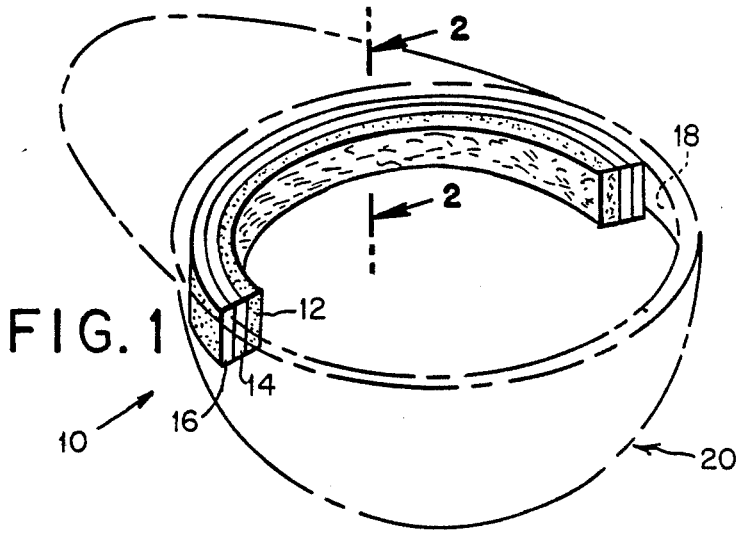
FIG. 1 is a perspective view of the instant invention shown installed in a cap illustrated in phantom.
Figure 2:
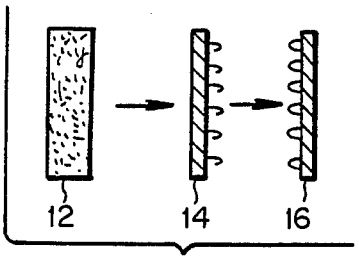
FIG. 2 is an exploded diagrammatic cross sectional view taken along the line 2—2 of FIG. 1.

Turning now descriptively to the drawings, in which like reference characters denote like elements throughout the several views, a sweat band 10 is shown to include an absorbent pad 12 having a hook pile fastener 14 adhered to a back side by an adhesive (not shown). A loop pile fastener 16 is provided and its back side may be fixedly secured by an adhesive to the surface of an existing sweat band 18 manufactured into a typical cap 20. The design is such, that perspiration from a wearer's forehead will be absorbed in the pad 12 and the fasteners 14 and 16 engage with each other and retain the pad 12 in the cap 20.

In use, the hook pile fastener 14 of the pad 12 is pressed against the loop pile fastener 16 secured to the existing sweat band of the cap 20.

When it is necessary to change the disposable pad 12, the pad 12 is peeled away with the integrally attached hook pile fastener material 14 from the loop pile fastener material 16. After the above, a new pad 12 with hook pile fastener material 14 is pressed into place on the mating corresponding loop pile fastener material 16 which has been previously installed on the existing sweat band 18 manufactured into the cap 20.

Figure 3:
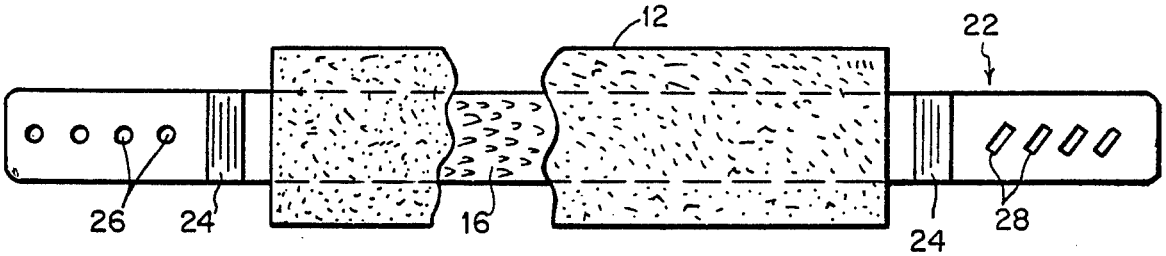
FIG. 3 is plan view of a second embodiment of the invention shown partly broken away.

Referring now to FIG. 3 of the drawing, an alternate embodiment of the invention is illustrated. In this case a pad 12 with its attached hook pile fastener 14 (not shown) is engaged with loop pile fastener 16 that is fixedly secured to a surface of a separate head band 22 having elastic portions 24 near each end, for stretching purposes. Equally spaced openings 28 are located on a first end of head band 22 and provide for adjustment of head band 22 for different head sizes, by selectively receiving any of the plurality of tines 26 that are also equally spaced apart along the second end of the head band 22.

The design of FIG. 3 is especially suitable for employment in industrial plants where there is usually no air conditioning and the workers do not wear caps or hats while working. In many such plants the temperature during summer months frequently reach over 100 degrees F. and employees often wear towels or large handkerchiefs around their foreheads to absorb perspiration, etc.

It shall be noted that the design of FIG. 3 may be manufactured with or without a sun visor.

In use, pad 12 as employed in FIG. 3, is attachable and removable in the same manner as was heretofore described.

Figure 4:
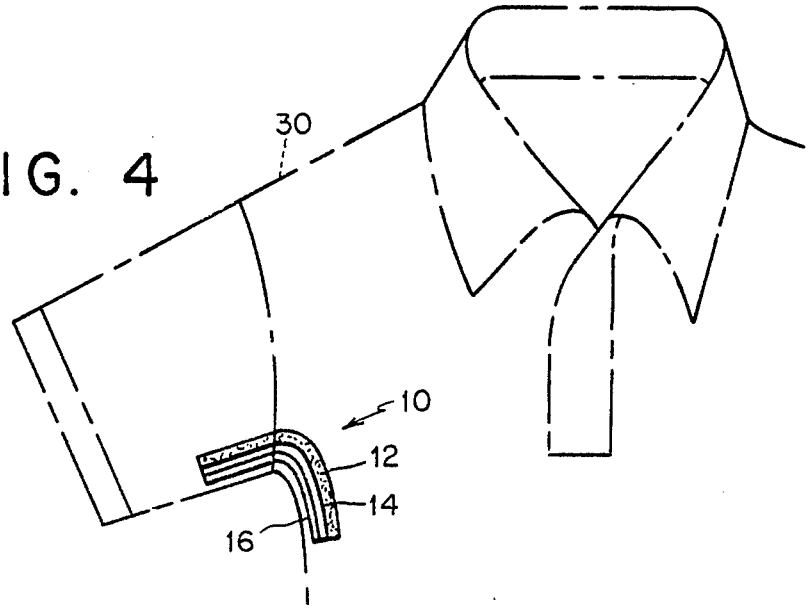
FIG. 4 is a side elevational view of a third embodiment of the invention.

Looking now at FIG. 4 of the drawing, pad 12 and its associated hook and loop pile fasteners 14 and 16 are employed as an underarm device in such articles as a shirt 30 or other garment. In this instance, the loop pile fastener 16 is fixedly secured in the underarm region of the shirt by stitching in a manner well known in the art, the pad 12 is employed to absorb underarm perspiration.

In use, pad 12 with its corresponding hook pile fastener mating material 14 is removed in the same manner as was above described.

It shall also be recognized that pad 12 may be washed and is so designed to provide maximum comfort due to its cushion effect, and pad 12 has the ability to absorb moisture without transferring it to the integrally attached hook pile fastener material 14.

Further, sweat band 10 prevents perspiration odors that are normally absorbed by head-wear, and band 10 can be replaced in seconds.

Even further, band 10 may be employed in hard hats of construction workers and may be manufactured in kit form for application to head-wear.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A quick change sweat band comprising:

(a) a central head band portion consisting of a long, narrow continuous width belt of flexible material having an inside surface, an outside surface, a top edge, a bottom edge, and first and second ends;

(b) a first narrow, flexible end portion having a width equal to the width of said belt and having a plurality of equally spaced openings centrally located along the length of said first end portion and extending from the first end of said belt;

(c) a second narrow, flexible end portion having a width equal to the width of said belt and having a plurality of equally spaced projecting knobs centrally located along the length of said second end portion and extending from the second end of said belt, the spacing of said projecting knobs being the same as the spacing of said openings;

(d) first and second pieces of flexible, stretchable material of the same width as said belt and extending a short distance along the length of said belt connected respectively between said first and second end portions and the first and second ends of said belt;

(e) a first fastener material of the hook and loop pile type secured to the inside surface of said belt;

(f) an absorbent pad having a front side and rear side and having a width slightly larger than the width of said belt, said pad having attached on the rear side thereof a second fastener material of the hook and pile type of the opposite type from said first fastener material, the second fastener material of said absorbent pad being adapted to removably engage the first fastener material secured to said belt whereby said pad extends a short distance beyond the top and bottom edges of said belt; and (g) the first and second end portions of said sweat bend being removably engagable whereby at least one of said projecting knobs is secured within one of said openings to form the sweat band into an adjustable loop of variable circumference adapted to maintain the front side of the absorbent pad against the wearer's head to absorb perspiration, said absorbent pad being removable and replaceable.

* * * * *